US005159902A

United States Patent [19]

Grimm

[11] Patent Number: 5,159,902

[45] Date of Patent: Nov. 3, 1992

[54] ROTARY VEE ENGINE WITH THROUGH-PISTON INDUCTION

[76] Inventor: C. Louis Grimm, 6042 Pflumm Rd., Shawnee, Kans. 66216

[21] Appl. No.: 635,999

[22] Filed: Dec. 31, 1990

[51] Int. Cl.[5] ..... F02B 57/06

[52] U.S. Cl. ..... 123/43 A; 91/500; 123/45 R

[58] Field of Search ..... 91/500; 92/31, 32; 123/43 A, 45 R, 45 A, 73 AA

[56] References Cited

U.S. PATENT DOCUMENTS

| | | | |
|---|---|---|---|
| 1,224,468 | 5/1917 | Johnson et al. | 123/45 R |
| 1,342,422 | 6/1920 | Chase | 123/45 R |
| 1,418,668 | 6/1922 | Nobbs | 123/73 AA |
| 1,670,549 | 5/1928 | Pearce | 123/45 R |
| 1,737,820 | 12/1929 | Ames | 123/45 R |
| 1,806,233 | 5/1931 | Adams | 123/45 R |
| 1,972,335 | 9/1934 | Gardner . | |
| 2,444,764 | 7/1948 | Baker . | |
| 2,902,468 | 9/1975 | Turner . | |
| 3,319,615 | 5/1967 | Girerd . | |
| 3,388,603 | 6/1968 | Clark . | |
| 3,626,911 | 12/1971 | Shaw . | |
| 3,757,748 | 9/1973 | Arney | 123/45 A |
| 3,830,208 | 8/1974 | Turner . | |
| 3,902,466 | 9/1975 | Gulko . | |
| 3,905,338 | 9/1975 | Turner . | |
| 3,973,531 | 8/1976 | Turner . | |
| 4,060,060 | 11/1977 | Turner . | |
| 4,366,784 | 1/1983 | Paul | 123/45 A |
| 4,372,179 | 2/1983 | Dolene et al. | 123/45 R X |
| 4,553,506 | 11/1985 | Bekiaroglou | 123/45 R |
| 4,648,358 | 3/1987 | Sullivan et al. . | |
| 4,867,107 | 9/1989 | Sullivan et al. . | |

FOREIGN PATENT DOCUMENTS 102363 10/1937 Australia ..... 91/500

OTHER PUBLICATIONS

Cavin, "Rotary Vee Engine", *Sport Aviation*, Feb. 1986; pp. 14–18.

*Primary Examiner*—Michael Koczo

*Attorney, Agent, or Firm*—Litman, McMahon & Brown

[57] ABSTRACT

A rotary vee engine with through-piston induction includes a housing supporting a pair of rotors positioned in an obtuse angular relation and having pluralities of cylinders mounted thereon about respective rotor axes. Aligned cylinders in the opposite rotors have vee shaped double piston assemblies slidable and rotatably received therein. Fuel/air charges are inducted into the cylinders through apex ports in the piston apex portions, through fluid passages in the pistons, piston intake ports in the piston heads, and cylinder intake grooves formed in the inner walls of the cylinders. The cylinder intake grooves in each cylinder include a pair of axially elongated grooves with a trailing groove being staggered toward a cylinder head in relation to a leading groove and in relation to cylinder exhaust ports positioned opposite the grooves. The piston intake port is circumferentially elongated at least a distance to overlap both grooves. In the operating cycle, the piston head moving toward bottom dead center opens the exhaust ports prior to opening the intake porting and, in moving away from the bottom dead center position closes the exhaust ports prior to closing the intake porting.

26 Claims, 4 Drawing Sheets

ROTARY VEE ENGINE WITH THROUGH-PISTON INDUCTION

FIELD OF THE INVENTION

The present invention relates to rotary vee engines and, more particularly, to such an engine in which fuel-/air charges are admitted into the cylinders through hollow pistons of the engine.

BACKGROUND OF THE INVENTION

Conventional reciprocating internal combustion engines are very complex mechanisms employing a great many parts which are subject to wear and which contribute to losses in efficiency due to friction. Friction occurs between the piston rings and cylinder walls as well as between members which convert and transfer the reciprocating motion of the pistons to rotary motion of the output shaft. In four stroke engines, the flow of fuel/air mixtures and exhaust gases is controlled by valve members driven by one or more camshafts which add further friction losses. Most modern four stroke engines, such as for automobiles, are liquid cooled which requires that coolant passages be formed in the blocks and heads. Another problem with conventional piston engines is vibrations which result principally from the pulsed nature of the power strokes and the reciprocating motion of the pistons. Despite the complexities, inefficiencies, and other problems of reciprocating piston engines, such engines have been very successful and form the majority of prime movers for ground transportation and many other uses.

Attempts have been made to develop more efficient internal combustion engines which solve the problems inherent in converntional piston engines. For the most part, successes in alternatives to piston engines have occurred in specific areas for certain engines. Gas turbine engines of various types have been applied very successfully to aircraft propulsion, as fairly larges engines, and more recently to military tanks. Wankel type rotary engines have been used successfully in some automobiles and motorcycles, although there were problems initially with excessive wear of rotor apex seals. Wankel engines have reduced vibrations compared to piston engines, and gas turbine engines have greatly reduced vibrations. Additionally, Wankel engines do not require intake and exhaust valves, these functions being controlled by corresponding ports which are effectively opened and closed by the rotor. Thus, Wankel engines have considerably fewer parts than four stroke piston engines.

Many small internal combustion piston engines are of the two stroke type. The principal advantages of two stroke engines are relative simplicity of their design and high power output compared to a four stroke of the same displacement and operating at the same speed. The increased simplicity results from simpler valving requirements. Whereas most four stroke engines employ at least one intake valve and one exhaust valve per cylinder, many two stroke engines employ only one such valve, the other function being controlled by cylinder ports which are opened and closed by the reciprocating piston. The theoretical power increase of two stroke engines results from the development of a power stroke for each revolution of the crankshaft, in contrast to one power stroke for every two crankshaft revolutions in four stroke engines.

The operating cycle of two stroke engines includes a compression stroke and an expansion or power stroke. Exhaust and intake functions occur respectively as the piston approaches and moves away from the bottom dead center position. Intake occurs in overlapping relation to exhaust with the intake cycle preferably beginning and ending respectively after the beginning and end of exhaust cycle. It is difficult to avoid retaining some portions of the exhaust gases within the cylinder after the exhaust function has ended. The relative ability of a two stroke engine to minimize the inclusion of exhaust gases in the fuel/air charge is referred to as the scavenging efficiency of the engine. Because a scavenging efficiency of 100 per cent cannot be realized in practice, the theoretical doubling of the power output of a two stroke engine over a comparable four stroke engine, likewise cannot be achieved.

A class of engines which combines aspects of rotary engines and two stroke engines is rotary vee engines. In a typical rotary vee engine, a pair of cylinder blocks have a plurality of cylinders bored therein in a ring about a cylinder block axis. The cylinder blocks are rotatably mounted with the block axes intersecting at an obtuse angle. Vee shaped double piston assemblies are received in each pair of aligned cylinders in the opposite blocks. The engine may have a drive shaft attached to either or both rotary cylinder blocks. If such a rotary vee engine is oriented with the drive shaft axes in a vertical plane and extending upwardly, as a given piston pair is revolved toward the top of the engine, heads of the pistons approach top dead center (TDC) positions within their respective cylinders. Similarly, as the piston pair is revolved toward the lower side of the engine, the piston heads approach bottom dead center (BDC) positions within their cylinders. Because of the geometry of typical rotary vee engines and because the only degree of freedom for the cylinder blocks is rotation about their axes, the ignition of fuel/air charges within the cylinders causes the cylinder blocks to rotate.

In contrast to the relatively fixed cylinders of conventional piston engines, the cylinders of a rotary vee engine rotate, thereby complicating the supply of fuel and air thereto. In many rotary vee engines, fuel and air are supplied to the piston apex region of the engine and inducted into the cylinders through passages cast into the cylinder blocks. While the casting of internal passages in a metal structure is well established in the metal working industry, it is nevertheless complex and, thus, expensive. The rotary vee engine disclosed in FIG. 6 of U.S. Pat. No. 3,820,208 simplifies the construction of such an engine somewhat by routing air to the cylinders through hollow pistons. However, the supply of fuel to the cylinders in this engine is fairly complex and includes a cam operated fuel injector in each cylinder which receives fuel from a rotary coupling associated with the drive shaft of the engine.

U.S. Pat. No. 3,902,468 discloses a rotary vee engine in which the apex region of the engine is used as a compressor to supercharge the engine. The inner surfaces of the cylinder blocks are disposed at complementary angles to their respective block rotation axes, and the apex portions of each cylinder pair engage inner and outer sealing walls. As the cylinder blocks rotate, the volumes between successive piston sets cyclically expand and contract. A compressible gas or gas mixture is drawn into the volumes as they expand, and the gas is compressed as the volumes contract. Passages are provided in the cylinder blocks to route the compressed gas to the cylinders for ignition and expansion therein to drive the engine.

SUMMARY OF THE INVENTION

The present invention is a rotary vee engine which incorporates some of the features described above and provides significant improvements over such configurations. The engine of the present invention has its apex region configured as a compressor which draws a fuel/air mixture thereinto and compresses same for induction into the cylinders at above-atmospheric pressure. The compressed fuel/air mixture is inducted into the cylinders through passages within the pistons. Each piston assembly is a tubular structure formed of piston halves which intersect at a "vee" angle of the engine to form a piston apex. Each piston half has a piston head at the free end thereof which is slidably and rotatably received in sealing relation within an associated cylinder.

Each cylinder is formed of at least one sleeve and, preferably, at least an inner cylinder liner and an outer cylinder sleeve. A plurality of cylinders is mounted in parallel, circumferential relation by a pair of support disks about a cylinder bank axis. An outer head disk has counterbores, into which the outer ends of the cylinders fit. Inner cylinder support disks have the cylinders extending therethrough. The engine is formed by a pair of cylinder banks or rotors comprising a plurality of cylinders supported by a pair of the disks. The cylinder banks are rotatably mounted with the cylinder bank axes intersecting at an obtuse "vee" angle. The cylinder banks engage support structure, which may comprise an engine housing, by way of respective sets of rotary and thrust bearings. The piston halves of each piston assembly are received in an aligned pair of cylinders in the opposite banks.

As the cylinder banks rotate, the piston assemblies are revolved about the intersecting bank axes in such a manner that each piston completes one revolution with respect to its cylinder per rotation of the cylinder bank. As each piston is revolved toward an inner elbow position of the vee engine, the piston head thereof approaches a top dead center (TDC) relationship to its cylinder head; and, conversely, as each piston is revolved toward an outer elbow position of the vee engine, its piston head approaches a bottom dead center (BDC) relationship with its cylinder head. The relative movement between each piston and cylinder set is, thus, a cyclic combination of linear reciprocation and rotary movement. This coordinated relative movement between each piston and cylinder is utilized to control the flow of fuel/air mixtures into the cylinder and the flow of exhaust gases from the cylinder.

An exhaust port is formed through the wall of each cylinder. The exhaust port is spaced longitudinally of the cylinder head to be opened by the piston head as it approaches the BDC position. The intake porting for the engine includes a piston intake port and one or more cylinder intake grooves formed into the internal cylinder wall. In preferred embodiments, a cylinder intake groove is formed by one or more slots formed through the wall of the cylinder liner and closed radially outwardly by the wall of the cylinder sleeve. The piston intake port is located near the piston head and cyclically aligns with the cylinder intake grooves, as a result of the relative rotary and reciprocating motion between the piston and the cylinder, to provide fluid communication between the fuel/air passage in the piston and the cylinder chamber.

The piston and cylinder intake ports are configured in coordination with the relative motion between the piston and cylinder and in cooperation with the exhaust port to cause the exhaust port to open before the intake porting opens and for the intake porting to remain open for a short interval after the exhaust port is closed. In order to achieve these objectives, the piston intake port is formed as a slot which is elongated circumferentially of the piston cylindrical axis through the tubular piston wall, and the cylinder grooves are a pair of grooves which are elongated longitudinally of the cylinder axis. The cylinder grooves are staggered longitudinally in the direction of rotation of the piston relative to the cylinder so that the piston intake port remains in communication with one of the grooves a short interval after the exhaust port has been closed. The overlapping relationship of the exhaust and intake cycles provides the necessary scavenging to maximize the removal of exhaust gases from the cylinder chamber before a fresh fuel/air charge is admitted thereinto.

Scavenging of the engine is further assisted by location of the exhaust port of each cylinder in facing relation to the rotational axis of the associated cylinder bank. A principal portion of the pressurized exhaust gases within a cylinder chamber is vented through the exhaust port between the instant it is opened and the time when communication is established between the piston passage and the cylinder chamber through the intake porting. Any exhaust gases remaining in the cylinder chamber, because of the temperature of the exhaust gases, is less dense than the cooler fuel/air mixture entering the cylinder chamber. Because the cylinder is being revolved away from the exhaust port, centrifugal forces on the cooler fuel/air mixture causes it to fill in and tend to remain in the cylinder chamber on the side opposite the exhaust port. Since the fuel/air charge is pressurized, it tends to force out a considerable portion of the remaining exhaust gases.

The configuration of a rotary vee engine according to the present invention with fuel/air charges inducted through the pistons greatly simplifies construction of such an engine, particularly with regard to the rotors supporting the cylinders and the cylinders themselves. In general, the majority of components for the rotary vee engine of the present invention may be formed from standard types of metal stock by relatively simple machining operations.

OBJECTS OF THE INVENTION

The principal objects of the present invention are: to provide an improved internal combustion engine; to provide an improved two-stroke cycle engine; to provide, particularly, an improved rotary vee engine; to provide such an engine with a means of inducting fuel/air charges which improves the operation of such an engine and simplifies construction of the engine; to provide such an engine with hollow pistons through which fuel/air charges are inducted into the cylinders of the engine; to provide such an engine including intake and exhaust ports which are positioned to make use of inherent reciprocating and rotary relative motion between the pistons and cylinders to control the induction of fuel/air charges into the cylinders; to provide such an engine with intake and exhaust ports which are configured to enhance the scavenging efficiency of such an engine by cyclically closing the exhaust ports prior to closing the intake ports; to provide such an engine wherein the exhaust ports are positioned toward the inside of each ring of cylinders whereby centrifugal force causes thermal stratification between a cooler, heavier incoming fresh fuel/air charge to force out the hotter, lighter expended fuel/air charge to thereby improve the scavenging efficiency of the engine; to provide such an engine wherein the inner surfaces of disks supporting the cylinders are conical and tangent and wherein space within the ring of the vertex regions of the pistons is filled by a double wedge shaped stuffer to form a compressor which is used to supercharge the fuel/air charges; to provide such an engine including lightly biased check valve members positioned at the vertices of the vee-shaped pistons which are aided in operation by centrifugal force to control the admission of fuel/air charges from the compressor section into the hollow pistons; to provide such an engine which is capable of a high power output to weight ratio; to provide such an engine which is adaptable in configuration and scale to a great variety of uses; to provide such an engine which is conveniently maintainable; and to provide such a rotary vee engine with through-piston induction which is economical to manufacture, efficient and durable in operation, and which is particularly well adapted for its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
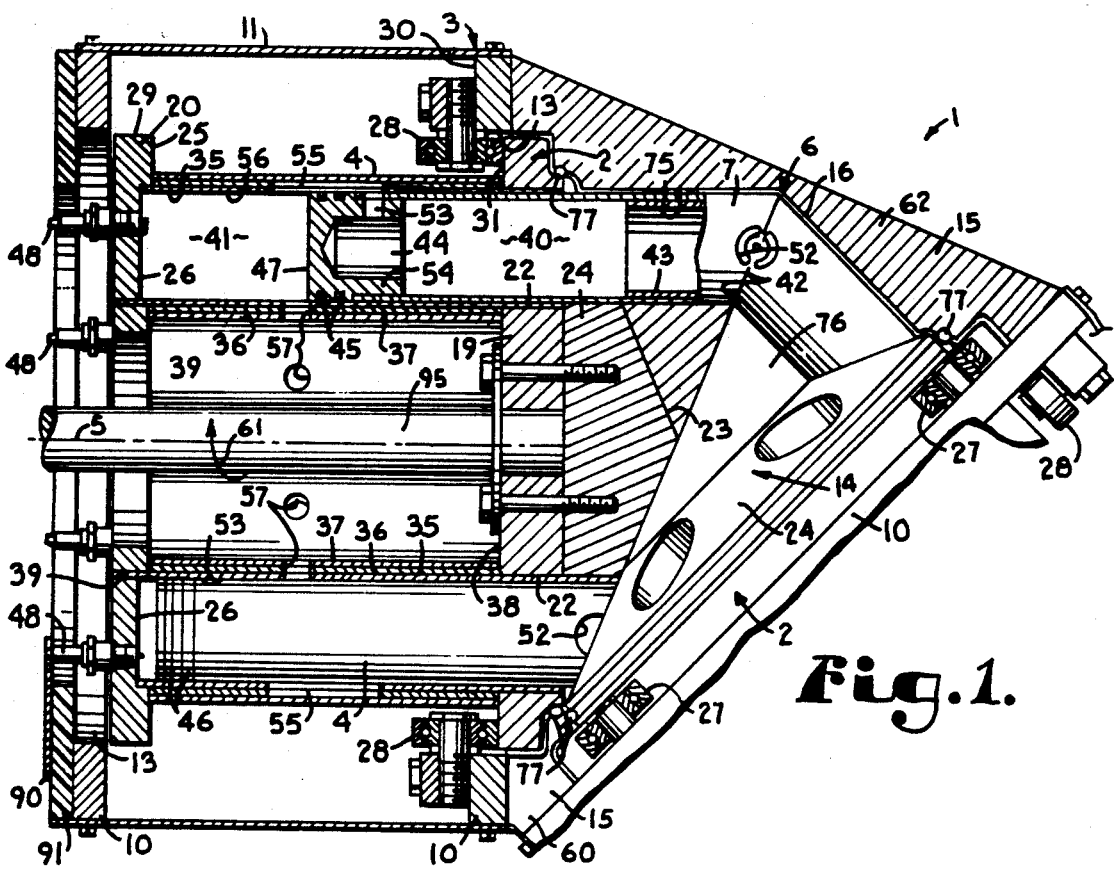
FIG. 1 is a fragmentary axial sectional view through a rotary vee engine embodying the present invention and illustrates construction details of the pistons, cylinders, and rotors.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a rotary vee engine with through-piston induction which embodies the present invention. The engine 1 generally includes a pair of rotor assemblies 2 rotatably mounted in an engine housing assembly 3 at an obtuse vee angle. Each rotor assembly 2 has a plurality of cylinders 4 mounted therein in an annular parallel relationship about a respective rotor axis 5. Each aligned pair of cylinders 4 in the opposite rotor assemblies 2 has a vee shaped piston assembly 6, formed by a joined pair of pistons 7, slidably and rotatably received therein. In the rotary vee engine 1 of the present invention, the pistons 7 are hollow and cooperate with the cylinders 4, as influenced by the relative motion between the pistons 7 and cylinders 4, to induct fuel/air charges through the hollow pistons 7 and into the cylinders 4 for ignition and expansion therein to cause rotation of the rotor assemblies 2 to thereby operate the engine 1.

The illustrated housing assembly 3 is a developmental housing rather than a type of housing which would be employed in a production engine. However, the housing assembly 3 is functional and helps to better illustrate the simplification of the engine 1 resulting from the present invention. The housing assembly 3 includes a pair of rotor support walls 10 for each rotor assembly 2, which are positioned in spaced apart, parallel relation. Each set of rotor support walls 10 is connected by top and bottom walls 11 and side walls 12. The side walls 12 for each rotor assembly 2 may be replaced by a pair of overall side walls (not shown) which have all four rotor support walls 10 connected therebetween to function as main supports for the components of the engine 1. The rotor support walls 10 have large circular apertures 13 therethrough to accommodate the components of the rotor assemblies 2.

Figure 2:
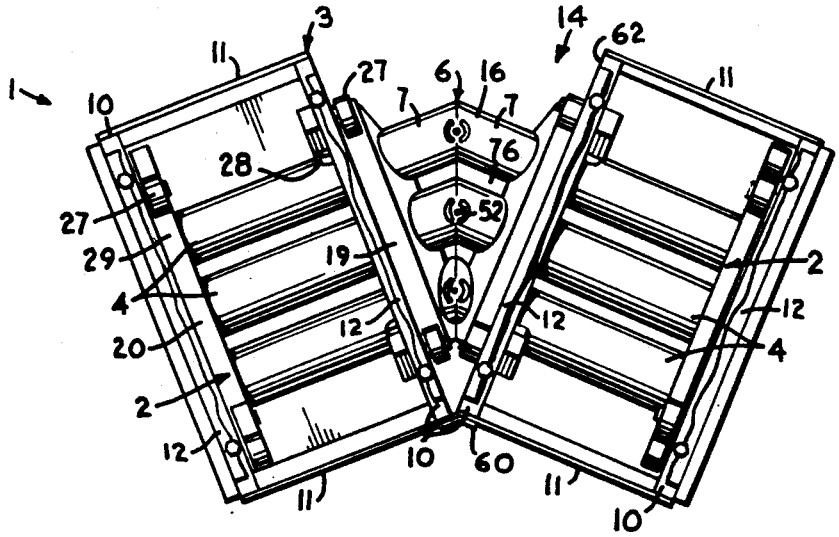
FIG. 2 is a side elevational view of the rotary vee engine at a reduced scale, shown with the center shell removed.
Figure 3:
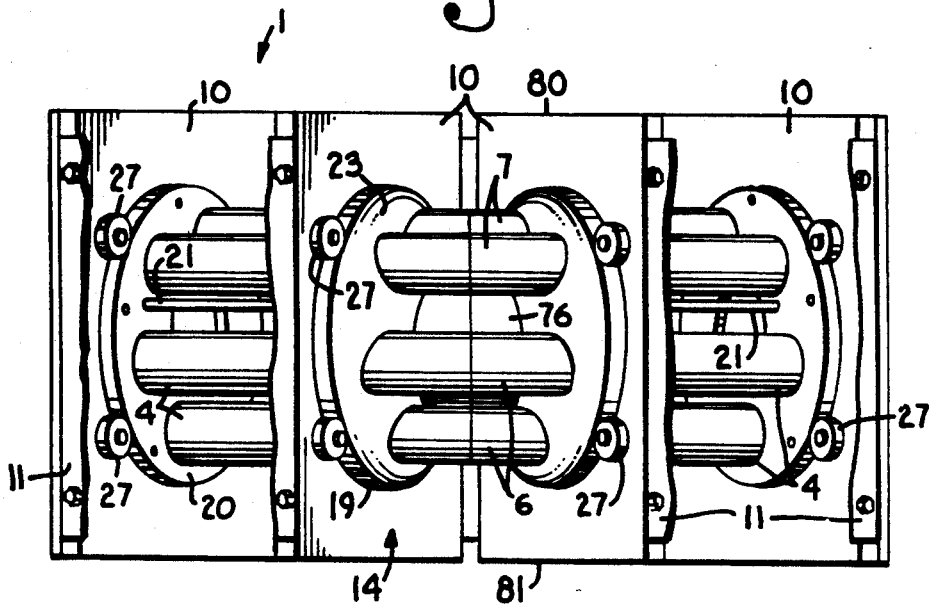
FIG. 3 is a top plan view of the engine shown from the bottom dead center side of the engine and with walls and a center shell removed to illustrate internal details.

A piston apex or vertex section 14 (FIGS. 2 and 3) of the engine 1 is surrounded by an apex shell 15 (FIG. 1) which externally conforms to the shape of the rest of the housing assembly 3 and internally is shaped for a close, but nonengaging, fit with apex portions 16 of the piston assemblies 6. The sets of rotor support walls 10 are secured to the apex shell 15 to form the rigid housing assembly 3. In a production engine 1, the housing assembly 3 may be formed as a set of cast housing halves with the rotor support walls 10 and apex shell 15 formed integrally therewith.

Each rotor assembly 2 is formed by an inner disk 19 and an outer disk 20 which are connected by a plurality of circumferentially spaced rods or bolts 21. The inner disks 19 have a plurality of cylinder receiving bores 22 formed therethrough in a circumferential pattern and having portions of the cylinders 4 extending therethrough. The illustrated engine 1 employs six cylinder 4 per rotor assembly 2. Inner surfaces 23 of the inner disks 19, within the apex section 14 of the engine 1, are conical and may be formed by conical members 24 secured to the inner disks 19. The inner surfaces 26 of the outer disks 20 have cylindrical recesses 26 formed therein to receive the outer ends of the cylinders 4. The recesses 26 form cylinder heads of the cylinders 4. The cylinders 4 of each rotor assembly 2 are mounted between the inner and outer disks 19 and 20 prior to connecting the disks with the rods 21. Similarly, the piston assemblies 6 are inserted in aligned sets of the cylinders 4 prior to assembling the housing 3.

The rotor assemblies 2 are mounted in the housing assembly 3 by sets of journal bearings 27 and thrust bearings 28. In the illustrated engine 1, there are four circumferentially spaced journal bearings 27 per disk 19 or 20, the bearings 27 being mounted on respective inner surfaces of the rotor support walls 10. The journal bearings 27 are commonly available types of roller bearings and are positioned to engage outer cylindrical surfaces 29 of the rotor disks 19 and 20. There are four thrust bearings 28 per inner disk 19 of the illustrated engine 1. The thrust bearings 28 may be similar to the journal bearings 27 and are secured in circumferential patterns on the outer surfaces 30 of the inner rotor support walls 10 and engage outer surfaces 31 of the inner disks 19.

Figure 6:
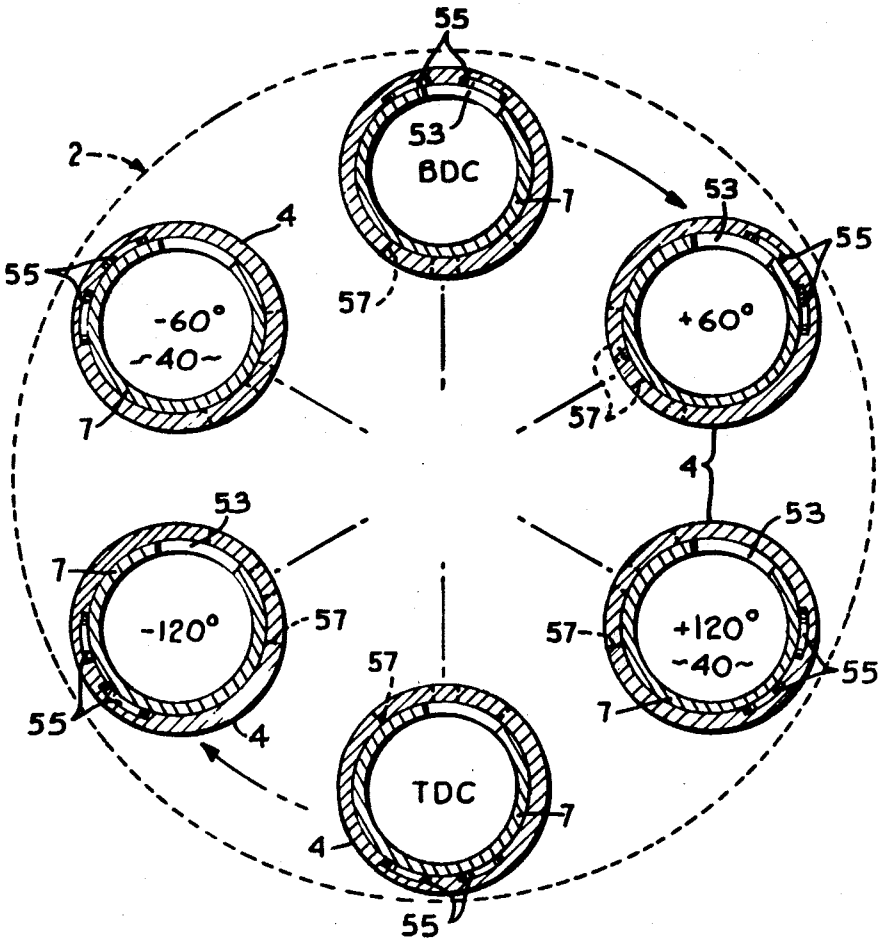
FIG. 6 is a diagrammatic transverse sectional view through the cylinders of one rotor of the engine and illustrates the cyclic relationships of the piston and cylinder ports at selected stages during the operating cycle of the engine.

The cylinders 4 are formed from cylindrical tubular stock, preferably of a standard size, and each may be a unitary tubular member which is machined as necessary, as shown in FIG. 6, or preferably are of a built-up construction, as is illustrated in FIG. 1. The cylinders 4 in FIG. 1 are formed of an internal cylinder liner 35, an intermediate cylinder member 36, and an external cylinder shell 37. The cylinder liner 35 is preferably steel, while the intermediate cylinder 36 and shell 37 may be aluminum. The liners 35 are somewhat longer than the cylinder components 36 and 37 and extend into the cylinder head recesses 26 and through the cylinder bores 22 in the inner rotor disks 19 to abut the outer surfaces 38 of the conical members 24. This prevents axial sliding of the liners 35 resulting from the reciprocating component of motion of the pistons 7 frictionally engaged with the liners 35. The ends of the intermediate cylinders 36 and shells 37 abut the inner surface 25 of the outer disks 20 and the outer surfaces 31 of the inner disks 19. The cylinder components 35, 26, and 37 incorporate some form of keying structure in cooperation with the rotor disks 19 or 20 to prevent the cylinder components from being rotated relative to the rotor disks from the frictional influence of the pistons 7 rotating therein. The illustrated liners 35 are rotationally fixed by key pins 39 engaging notches (not shown) in the outer ends of the liners 35. The inner surface of the cylinders 36 should be machined to a true cylindrical shape and honed to a smooth finish and may be replaceable for long term maintenance of the engine 1.

Each piston assembly 6 includes a pair of pistons joined together at the vee angle of the engine 1 which, in the illustrated engine 1, is 135 degrees. The pistons 7 are tubular to provide a fluid passage 40 for the induction of fluid/air charges into the cylinder chambers 41, as will be detailed further below. The pistons 7 are mitered at their inner ends 42 at an angle to create the desired vee angle which requires a 22.5 degree miter angle relative to the piston cylindrical axes to provide the 135 degree vee angle. The piston members 7 are joined by an angled elbow member 43 over which the piston members 7 are sleeved and secured in place, as by a high temperature adhesive. The outer or head ends of the pistons 7 receive piston heads 44 which may be formed by machining and which are press fit into the tubular piston members 7. The piston heads 44 preferably have circumferential grooves 45 to receive piston rings 46. Outer piston head surfaces 47 face the cylinder heads 26, and the pressure of fuel/air charges ignited within the cylinder chambers 41, as by spark plugs 48, acts against the surfaces 47 to drive the pistons 7 away from the cylinder heads 26 to cause rotation of the rotor assemblies 2.

Figure 4:
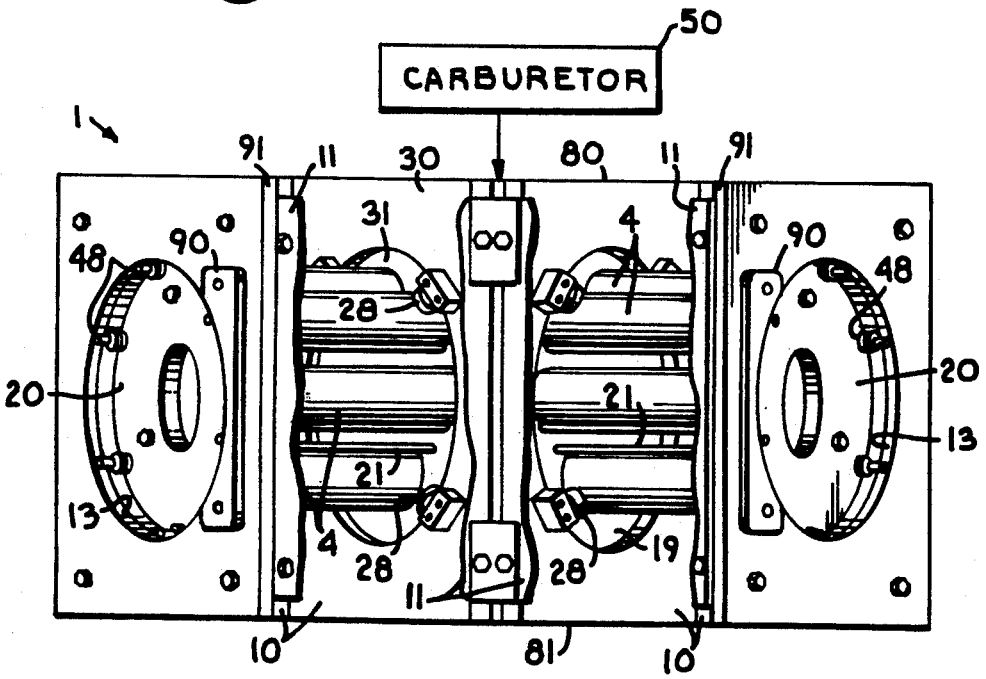
FIG. 4 is a bottom plan view of the engine from a top dead center side of the engine with walls removed to illustrate internal details.

Fuel/air charges are routed from a fuel/air source, such as a carburetor 50 (FIG. 4), to the apex section 14, through the fluid passages 40 in the pistons 7, and into the cylinder chambers 41. The engine 1 exploits the relative rotary and reciprocating motion of the pistons 7 with respect to the cylinders 4 to control the flow of fuel/air charges through the engine 1 and the flow of exhaust gases from the cylinders 4. The piston assemblies 6 have apex piston intake ports 52 formed near the mitered ends 42 of the pistons 7. The piston heads 44 have piston intake ports 53 formed through side walls 54 which are positioned to cyclically communicate with cylinder intake grooves 55 formed into the inner surfaces 56 of the cylinders 4. In a preferred embodiment of the engine 1, the cylinder intake grooves 55 are formed by apertures formed through the cylinder liners 35 and the intermediate cylinders 36. The cylinders 4 have exhaust ports 57 formed through their walls to provide fluid communication between the cylinder chambers 41 and the external environment, as illustrated, or preferably to an exhaust system (not shown).

Figure 5:
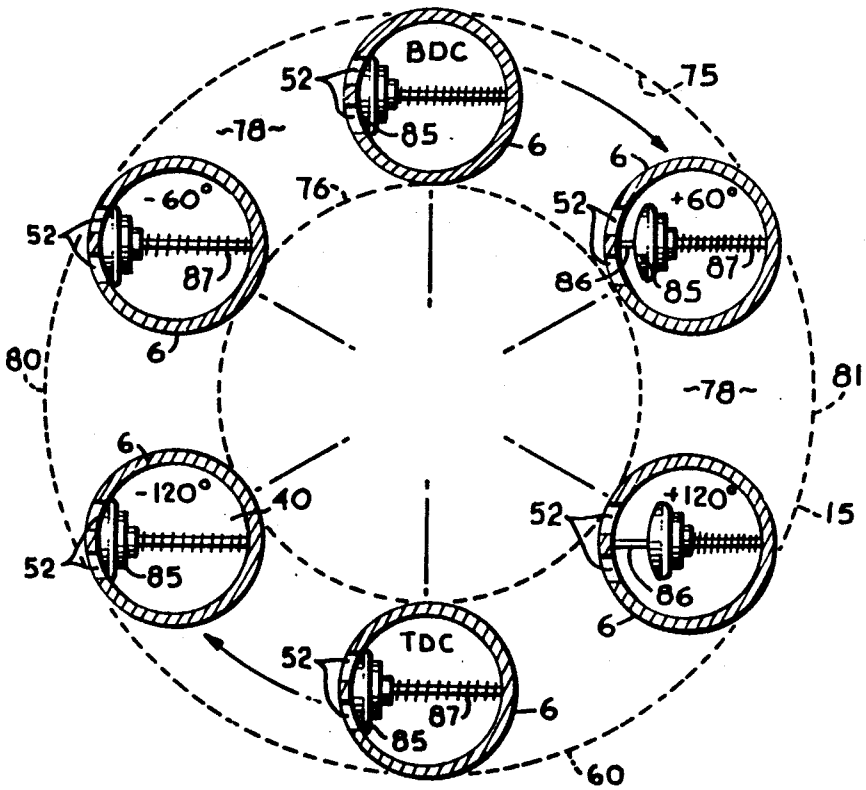
FIG. 5 is a diagrammatic transverse sectional view through the center plane of the vertex section of the engine and illustrates the cyclic functioning of a centrifugally assisted induction valve at selected stages during the operation cycle of the engine.

Referring to FIGS. 1, 5, and 6, the exhaust ports 57 are located on the inwardly facing sides of the cylinders 4, with respect to the rotor axes 5, while the cylinder intake grooves 55 are located on the outwardly facing sides of the cylinders 4. Since the cylinders 4 are fixed with respect to the rotor disks 19 and 20, as the rotor assemblies 2 rotate, the exhaust ports 57 are maintained in their inwardly facing orientations while the intake grooves 55 are maintained in their outwardly facing orientations. Because of the angled geometry of the engine 1, and rotary vee engines in general, in which corresponding cylinders in the opposite rotors 2 rotate about respective axes 5 which are mutually angled, the piston assemblies 6 orbit about the axes 5, such that the piston ports 52 and 53 always face a given direction, external to the engine 1. Thus, there is relative rotary motion between any cylinder 4 and the piston 7 therein.

In FIG. 5, the apex ports 52 of the piston assemblies 6 always face to the left, as viewed, throughout the rotation of the rotor assemblies 2. Similarly, in FIG. 6, the piston intake ports 53 always face upwardly, as viewed, as the rotor assemblies 2 rotate. Conversely, in FIG. 6, the cylinder intake grooves 55 rotate about the piston intake ports 53 as the rotor assemblies 2 rotate, while the exhaust ports 57 rotate about the pistons 7.

Figure 7:
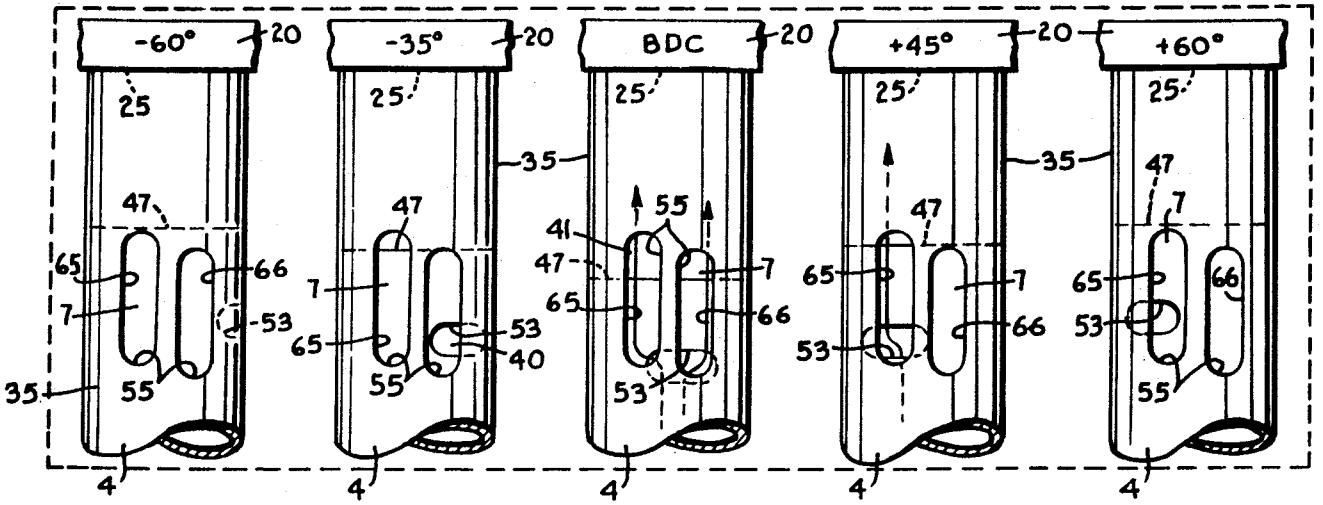
FIG. 7 is a diagrammatic sequential view of one of the engine cylinder liners at engine cycle stages before, during, and after the bottom dead center position of the piston relative to the cylinder and illustrates the cyclic cooperation of the piston intake ports and the cylinder intake slots at such stages.
Figure 8:
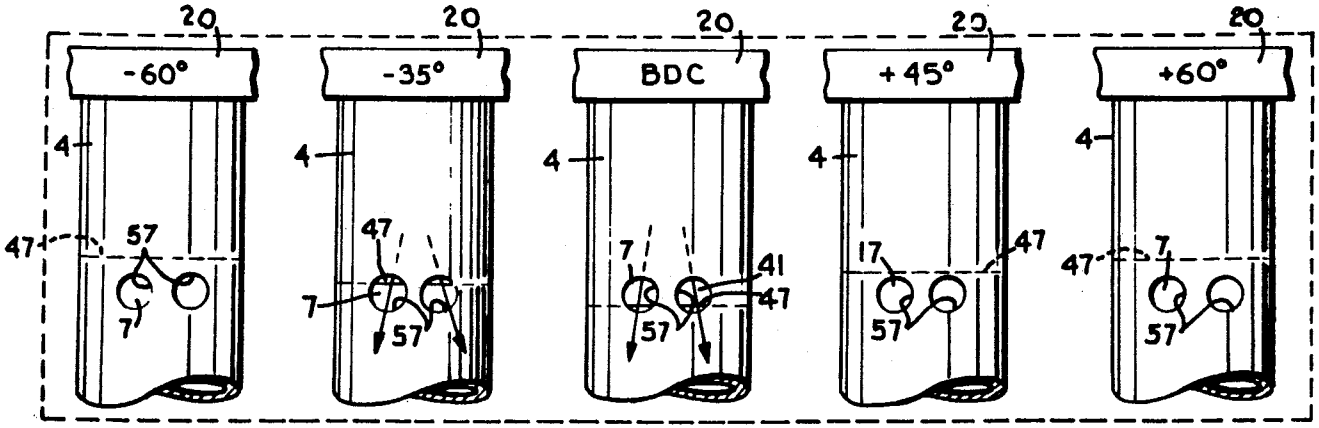
FIG. 8 is a diagrammatic sequential view of one of the engine cylinders at engine cycle stages before, during, and after the bottom dead center position and illustrates the cyclic cooperation of the cylinder exhaust ports and the head of the piston.

FIGS. 7 and 8 diagrammatically illustrate the relative positions of the piston intake port 53, cylinder intake grooves 55, exhaust ports 57, and piston head surface 47 of a cylinder 4 at selected stages of the operating cycle of the engine 1. The engine 1 is a two-stroke cycle engine in which ignition occurs just prior to a top dead center (TDC) position of the piston 7 on a TDC side 60 (FIG. 1) of the engine 1, followed by an expansion stroke in which the piston 7 is urged away from the cylinder head 26, causing the rotor assembly 2 to revolve the cylinder 4 in the direction of arrow 61 of FIG. 1 toward a bottom dead center (BDC) side 62 of the engine 1. In two-stroke engines, it is desirable to open the exhaust port or valve to vent a large portion of the exhaust gases prior to opening the intake port or valve. However, in conventional two-stroke engines, opening the exhaust valve prior to the intake valve requires that the exhaust valve remain open after the intake valve closes, which usually causes some exhaust gases to be retained in the cylinder with the fresh charge and the expulsion of some unburned fuel through the exhaust valve, resulting in less than optimum engine performance and fuel economy.

The engine 1 of the present invention improves upon conventional two-stroke engines by exploiting the combined reciprocating and rotary relative motion between the piston 7 and cylinder 4 to cause the exhaust ports 57 to open prior to the intake ports 53/55 and to cause the intake ports 53/55 to remain open after the exhaust valves 57 have been closed. To accomplish this, the piston intake port 53 is formed as a slot which is elongated circumferentially of the cylindrical axis of the piston 7, and two cylinder intake grooves 55 are provided per cylinder 4. The grooves 55 are elongated parallel to the cylindrical axis of the cylinder 4. In particular, the grooves 55 are staggered with respect to the longitudinal dimension of the cylinder 4 with a trailing groove 65 being positioned closer to the cylinder head 26 than a leading groove 66.

In FIGS. 7 and 8 at 60 degrees before BDC or −60 degrees, the piston head surface 47 is moving downwardly, as viewed, toward the intake grooves 55 and the exhaust ports 57, and the piston intake port 53 is rotating from right to left as viewed. In the ensuing description, for convenience, the piston head surface 47 will be referred to as the means for opening and closing the cylinder porting. However, strictly speaking, it is the outermost of the piston rings 46 which actually controls the cylinder porting. At −35 degrees, the piston head surface 47 has opened the exhaust ports 57, whereby venting of the exhaust gases begins. At the same time, the piston head surface 47 has opened the trailing groove 65, and the piston intake port 53 is communicating with the leading groove 66. The fresh fuel/air charge within the piston fluid passage 40 cannot be transferred to the cylinder chamber 41 until the piston head surface 47 opens the leading groove 66.

At bottom dead center, the exhaust ports 57 are fully open, the leading groove 66 is in full communication with the piston intake port 53, and the piston port 53 is beginning to communicate with the trailing groove 65. Thus, exhaust venting continues while the fresh fuel/air charge simultaneously flows from the piston passage 40 into the cylinder chamber 41. At 45 degrees past BDC, the piston head surface 47 is moving back toward the cylinder head 26, and the exhaust ports 57 have been completely closed. However, the piston port 53 is in full communication with the trailing groove 65 which is still open to the cylinder chamber 41, such that the transfer of fuel and air thereto continues after the exhaust ports 57 have been closed. At 60 degrees past BDC, and both the exhaust ports 57 and the intake grooves 55 have been closed, although the piston port 53 is still in communication with the trailing groove 65, and the piston head surface 47 continues toward the cylinder head 26, whereby the fuel/air charge within the cylinder chamber 41 is compressed.

The exhaust ports 57 are oriented toward the rotor axes 5 and the intake porting 53/55 away from the rotor axes 5 to cause centrifugal stratification of the fresh fuel/air charge and the exhaust gases within the cylinder chamber 41. Because of the pressure of the exhaust gases, a major portion of the exhaust gases are vented as soon as the exhaust ports 57 are opened. The exhaust gases remaining in the cylinder chamber 41 are hotter and, thus, less dense than the fresh fuel/air charge which enters the chamber 41 when the intake porting 53/55 opens. By placing the intake porting 53/55 radially outward of the exhaust ports 57, centrifugal forces on the heavier fuel/air charge, resulting from the rotation of the rotor assemblies 2, urge the heavier fuel/air charge to remain on the radially outward side of the cylinder chamber 41 which, in turn, urges the less dense exhaust gases out the exhaust ports 57 to improve the scavenging of the exhaust gases from the cylinder chambers 41.

Because two-stroke engines do not incorporate a vacuum induced intake stroke, as four-stroke engines do, it is necessary to provide a means for pressurizing the fuel/air mixture to positively urge the mixture into the cylinders. This may be accomplished by an external supercharger or, more commonly, by an internal supercharger, such as a crankcase supercharger in which the underside of the piston compresses the mixture during the expansion stroke of the cylinder. In a preferred embodiment of the engine 1, the apex section 14 is provided with means to compress the fuel/air mixture.

Referring to FIGS. 1 and 5, the conical surfaces 23 of the inner rotor disks 19 of the two rotor assemblies 2 are tangent on the TDC side 60 of the engine 1. The piston apex portions 16 move in a circle in close proximity to inner surfaces 75 of the apex shell 15. The volume within the circle of piston assemblies 6 within the apex section 14 is filled with a stuffer 76 which has a shape to slidingly seal with the conical surfaces 23 of the rotors 2 and the apex portions of the piston assemblies 6. The stuffer 76 is not attached to any structure within the engine 1 and, in effect, "floats" during rotation of the rotors 2. The inner rotor disks 19 sealingly engage the apex shell 15 by means of O-rings 77. Interpiston volumes 78 between successive piston apex portions 16 and between the apex shell inner surfaces 75 and the stuffer 76 expand as the volumes 78 are revolved from the TDC side 60 of the engine 1 toward the BDC side 62 and contract from the BDC side 62 toward the TDC side 60. Thus, a vacuum is created in the volumes 78 on a vacuum, or lower than ambient pressure, side 80 of the engine 1 from the TDC side 60 toward the BDC side 62, and the volumes 78 are compressed on a compression, or higher than ambient pressure, side 81 from the BDC side 62 toward the TDC side 60.

The carburetor 50 (FIG. 4) is connected to the engine 1 on the vacuum side 80 to communicate with the expanding volumes 78. This provides negative pressure within the carburetor 50 to draw in air and fuel and to atomize the fuel. The fuel may constitute a mixture of a combustible fuel and an engine lubricant to provide lubrication for the frictionally engaging components within the engine 1.

The flow of fuel and air from the interpiston volumes 78 may be controlled by apex valves 85 which cooperate with the apex ports 52. The illustrated apex valves 85 are centrifugally assisted check valves. The valve members 85 are slidingly mounted on rods 86 and are urged by light compression springs 87 to close the apex ports 52. As the piston assemblies 6 are revolved toward the vacuum side 80 of the engine 1, a combination of centrifugal force and the force of the springs 87 urge the apex valves 85 to seat, thereby closing the apex ports 52. As the piston assemblies 6 are revolved toward the compression side 81 of the engine 1, a combination of the pressure of the fuel/air mixture being compressed within the volumes 78 and centrifugal force overcomes the force of the springs 78 whereby the apex valves 85 unseat and allow the pressurized fuel/air mixture to flow from the volumes 78 into the piston fluid passages 40. Thus, the fuel/air mixture within the fluid passages 40 is pressurized and is positively inducted from the piston fluid passages 40 into the cylinder chambers 41, as previously described.

The spark plugs 48 may be fired by an ignition system (not shown) which senses the rotational position of the rotor assemblies 2, as by Hall effect sensors (not shown) and which cyclically applies high voltage pulses by way of spark electrode plates 90 which are mounted in proximity to the spark plugs 48 on the TDC side 80 of the engine 1, on the outer rotor support plates 10 through insulator plates 91. Rotational power may be transmitted from the engine 1 by one or two drive shafts 95 connected to the rotor disks, such as the inner disk 19, and positioned along the rotor axes 5. Alternatively, gears (not shown) may be formed or mounted directly on the rotor disks 19 or 20.

The rotor assemblies 2, according to the present invention, are greatly simplified since the induction of fuel/air charges through the piston passages 40 to the cylinder chambers 41 removes the need for fuel or air passages to be provided in other parts of the rotor assemblies 2. It is foreseen that exhaust collection structure (not shown) would be desirable in the engine 1. Such structure may take the form of disks (not shown) which are positioned on opposite sides of the exhaust ports 57 with the cylinders 4 extending therethrough. Such disks would cooperate with stationary plates and conduits (not shown) to conduct the exhaust gases to a safe venting area.

It is to be understood that while certain forms of the present invention have been illustrated and described herein, it is not to be limited to the specific forms or arrangement of parts described and shown.

What is claimed and desired to be secured by Letters Patent is as follows:

1. In an engine including a piston and a cylinder, the improvement comprising:

(a) said piston having an elongated tubular piston wall closed at one end by a piston head having a piston head face to define a fluid passage and having piston seal ring means encircling said piston head;

(b) said cylinder having an elongated inner cylinder surface closed at one end by a cylinder head surface to define a cylinder chamber, said cylinder receiving said piston therein with said ring means in sealing engagement with said cylinder surface;

(c) means causing cyclic relative motion between said piston and said cylinder during operation of said engine between a top-dead-center (TDC) position and a bottom-dead-center (BDC) position of said piston relative to said cylinder;

(d) a piston intake port formed through said piston wall in spaced relation to said piston head face on an opposite side of said ring means from said piston head face;

(e) cylinder intake groove means formed into said cylinder surface in spaced relation to said cylinder head surface;

(f) a cylinder exhaust port formed through said cylinder surface in spaced relation to said cylinder head surface and said groove means, said exhaust port being closed by said ring means being positioned between said exhaust port and said TDC position;

(g) means communicating a fuel/air charge to said piston fluid passage; and (h) said relative motion being of such a configuration and said piston intake port, said groove means, and said exhaust port being mutually positioned such that said ring means opens said exhaust port upon said piston approaching said BDC position to exhaust an expended charge and said piston intake port aligning with said groove means thereby enabling and maintaining fluid communication between said fluid passage and said cylinder chamber through said intake port and said groove means subsequent to said BDC position and after said exhaust port has been closed to thereby admit a fresh fuel/air charge into said cylinder chamber.

2. An engine as set forth in claim 1 wherein said relative motion includes:

(a) linear relative motion between said piston and cylinder; and (b) rotary relative motion between said piston and said cylinder about a cylindrical axis of said cylinder.

3. An engine as set forth in claim 1 wherein:

(a) said engine is a rotary vee engine including:

(1) a vee shaped piston member having each outer end in the form of said piston, the pistons intersecting at an obtuse vee angle;

(2) a pair of rotor assemblies supported to rotate about respective rotor axes intersecting at said vee angle, each of said rotor assemblies having a rotor cylinder in the form of said cylinder; and (3) each of said pistons being slidably and rotatably received in a respective rotor cylinder.

4. An engine as set forth in claim 1 wherein:

(a) said groove means is axially elongated; and (b) said piston intake port is a circumferentially elongated piston intake slot.

5. An engine as set forth in claim 1 wherein:

(a) said cylinder includes an outer cylinder sleeve and an inner cylinder liner; and (b) said groove means is formed through said liner.

6. An engine as set forth in claim 1 and including:

(a) a plurality of cylinders similar to said cylinder;

(b) a plurality of pistons similar to said piston;

(c) first and second banks of said cylinders, each bank including a plurality of said cylinders oriented in a parallel relation and positioned in a ring about a bank axis parallel to said cylinders;

(d) said first and second banks being rotatably supported with the bank axes thereof in an obtuse angular relation for revolution of the cylinders of each bank about the associated bank axis; and (e) said pistons being joined in pairs in said obtuse angular relation and each joined pair being received in a respective pair of said cylinder in opposite banks.

7. An engine as set forth in claim 6 wherein:

(a) each of said banks includes a pair of axially spaced parallel disks oriented perpendicular to and supporting the cylinders of said bank; and (b) said engine includes support means having bearing means engaged by said disks of said banks to rotatably support same.

8. An engine as set forth in claim 7 wherein each pair of said disks includes:

(a) an inner disk having inner ends of said cylinders in said bank extending therethrough; and (b) an outer disk having outer ends of said cylinders in said bank set therein, said outer disk forming cylinder heads of said cylinders in said bank.

9. A engine as set forth in claim 8 wherein said support means includes:

(a) a pair of support plates for each bank, each of said plates being oriented parallel to a respective one of said disks of said bank and positioned adjacent to the respective disk;

(b) an inner plate of each pair of plates having circumferentially spaced sets of rotary bearings and thrust bearings engaged by said respective disk; and (c) an outer plate of each pair of plates having circumferentially spaced sets of rotary bearings.

10. An engine as set forth in claim 7 wherein:

(a) each of said pairs of disks includes an inner disk, the inner disks of said banks having facing conical surfaces which are tangent at a tangent conical element line;

(b) the pistons of each of said joined piston pairs intersect at a respective piston apex region, the piston apex regions revolving through a substantially wedge shaped annular space between said inner surfaces of said inner disks;

(c) stuffer means is positioned within internal space encircled by said annular space and fills said internal space;

(d) said support means includes outer shell means sealingly engaged by said inner disks and encircling said annular space; and (e) a respective volume of said annular space between a successive set of piston apex regions diminishing upon being revolved toward a piston top-dead-center (TDC) position at said tangent line and expanding upon being revolved toward a piston bottom-dead-center (BDC) position at a location diametrically opposite said tangent line across said disks, whereby a compressible fluid within said volume is compressed upon said volume being revolved toward said TDC position and is rarefied upon being revolved toward said BDC position.

11. In an engine having a piston, a cylinder, and means causing reciprocating relative motion and rotary relative motion between said piston and said cylinder during operation of said engine, the improvement comprising:

(a) said piston having a fluid passage formed therethrough;

(b) means communicating a fuel/air charge to said passage for combustion and expansion in said cylinder to displace said piston therein to operate said engine;

(c) piston intake port means formed through said piston and in communication with said passage;

(d) cylinder intake port means formed within said cylinder and an exhaust port formed through said cylinder;

(e) said piston intake port means and said cylinder intake port means being sized, shaped, and positioned in such a manner that said reciprocating and rotary motion between said piston and cylinder causes said charge to be communicated from said passage to said cylinder through said piston intake port means and said cylinder intake port means in a sequence timed to the relative positions of said piston and cylinder to cause operation of said engine;

(f) said piston including an elongated tubular piston wall closed at one end by a piston head to partially define said fluid passage;

(g) said cylinder including an elongated cylinder wall having an inner cylinder surface closed at one end by a cylinder head surface to define a cylinder chamber;

(h) said piston intake port means including a piston intake port formed through said piston wall in axially spaced relation to said piston head;

(i) said cylinder intake port means including cylinder intake groove means formed into said cylinder wall;

(j) said piston intake port means and said groove means being shaped respectively and positioned mutually such that said relative motion cyclically aligns said piston intake port with said groove means to provide said fluid communication from said fluid passage to said cylinder chamber through said piston intake port and said groove means;

(k) said groove means including a pair of axially elongated grooves positioned in circumferentially spaced relation; and (l) said grooves being axially staggered.

12. In an engine having a piston, a cylinder, and means causing reciprocating relative motion and rotary relative motion between said piston and said cylinder during operation of said engine, the improvement comprising:

(a) said piston having a fluid passage formed therethrough;

(b) means communicating a fuel/air charge to said passage for combustion and expansion in said cylinder to displace said piston therein to operate said engine;

(c) piston intake port means formed through said piston and in communication with said passage;

(d) cylinder intake port means formed within said cylinder and an exhaust port formed through said cylinder;

(e) said piston intake port means and said cylinder intake port means being sized, shaped, and positioned in such a manner that said reciprocating and rotary motion between said piston and cylinder causes said charge to be communicated from said passage to said cylinder through said piston intake port means and said cylinder intake port means in a sequence timed to the relative positions of said piston and cylinder to cause operation of said engine;

(f) a plurality of cylinders similar to said cylinder;

(g) a plurality of pistons similar to said piston;

(h) first and second banks of said cylinders, each bank including a plurality of said cylinders oriented in a parallel relation and positioned in a ring about a bank axis parallel to said cylinders;

(i) said first and second banks being rotatably supported with the bank axes thereof in an obtuse angular relation for revolution of the cylinders of each bank about the associated bank axis;

(j) said pistons being joined in pairs in said obtuse angular relation and each joined pair being received in a respective pair of said cylinders in opposite banks;

(k) each of said banks including a pair of axially spaced parallel disks oriented perpendicular to and supporting the cylinders of said bank;

(l) said engine including support means having bearing means engaged by said disks of said banks to rotatably support same;

(m) each of said pairs of disks including an inner disk, the inner disks of said banks having facing conical surfaces which are tangent at a tangent conical element line;

(n) the pistons of each of said joined piston pairs intersecting at a respective piston apex region, the piston apex regions revolving through a substantially wedge shaped annular space between said inner surfaces of said inner disks;

(o) stuffer means being positioned within internal space encircled by said annular space and filling said internal space;

(p) said support means including outer shell means sealingly engaged by said inner disks and encircling said annular space;

(q) a respective volume of said annular space between a successive set of piston apex regions diminishing upon being revolved toward a piston top-dead-center (TDC) position at said tangent line and expanding upon being revolved toward a piston bottom-dead-center (BDC) position at a location diametrically opposite said tangent line across said disks, whereby a compressible fluid within said volume is compressed upon said volume being revolved toward said TDC position and is rarefied upon being revolved toward said BDC position;

(r) fuel/air charge supply means communicating with said annular region through said outer shell means at an angular position relative to rotation of said banks at which said volumes are approaching said BDC position; and (s) apex check valve means positioned at an apex region of each of said joined pairs of pistons, said valve means being biased to open upon approaching said BDC position to communicate a compressed fuel/air charge from a respective volume into a joined pair of said pistons.

13. An engine as set forth in claim 12 wherein:

(a) said valve means are positioned about each apex region such that centrifugal force caused by revolution of said pistons urges said valve means closed when said volumes are expanding and urges said valve means open when said volumes are diminishing.

14. In an engine including a piston and a cylinder, the improvement comprising:

(a) said piston having an elongated tubular piston wall closed at one end by a piston head having a piston head face to define a fluid passage and piston seal ring means encircling said piston head;

(b) said cylinder having an elongated inner cylinder surface closed at one end by a cylinder head surface to define a cylinder chamber, said cylinder receiving said piston therein with said ring means in sealing engagement with said cylinder surface;

(c) means causing cyclic relative motion between said piston and said cylinder during operation of said engine between a top-dead-center (TDC) position and a bottom-dead-center (BDC) position of said piston relative to said cylinder;

(d) a piston intake port formed through said piston wall in spaced relation to said piston head face on an opposite side of said ring means from said piston head face;

(e) cylinder intake groove means formed into said cylinder surface in spaced relation to said cylinder head surface;

(f) a cylinder exhaust port formed through said cylinder surface in spaced relation to said cylinder head surface and said groove means, said exhaust port being closed by said ring means being positioned between said exhaust port and said TDC position;

(g) means communicating a fuel/air charge to said piston fluid passage;

(h) said relative motion being of such a configuration and said piston intake port, said groove means, and said exhaust port being mutually positioned such that said ring means opens said exhaust port upon approaching said BDC position to exhaust an expended charge and said piston intake port aligning with said groove means thereby enabling and maintaining fluid communication between said fluid passage and said cylinder chamber subsequent to said BDC position and after said exhaust port has been closed to thereby admit a fresh fuel/air charge into said cylinder chamber;

(i) said groove means including a pair of axially elongated grooves positioned in circumferentially spaced relation, each of said grooves having a top end toward said cylinder head surface;

(j) a first of said grooves being positioned diametric to said exhaust port across said cylinder and having the top end thereof axially aligned with said exhaust port such that said piston ring means closes the first groove and said exhaust port substantially simultaneously; and (k) a second of said grooves is axially staggered with respect to said first groove in a direction toward said cylinder head surface such that the second groove remains in communication with said piston intake port for an interval after said first groove has been closed.

15. In an engine including a piston and a cylinder, the improvement comprising:

(a) a plurality of pistons, each piston having an elongated tubular piston wall closed at one end by a piston head having a piston head face to define a fluid passage and piston seal ring means encircling said piston head;

(b) a plurality of cylinders, each cylinder having an elongated inner cylinder surface closed at one end by a cylinder head surface to define a cylinder chamber, said cylinder receiving said piston therein with said ring means in sealing engagement with said cylinder surface;

(c) means causing cyclic relative motion between said piston and said cylinder during operation of said engine between a top-dead-center (TDC) position and a bottom-dead-center (BDC) position of said piston relative to said cylinder;

(d) a piston intake port formed through said piston wall in spaced relation to said piston head face on an opposite side of said ring means from said piston head face;

(e) cylinder intake groove means formed into said cylinder surface in spaced relation to said cylinder head surface;

(f) a cylinder exhaust port formed through said cylinder surface in spaced relation to said cylinder head surface and said groove means, said exhaust port being closed by said ring means being positioned between said exhaust port and said TDC position;

(g) means communicating a fuel/air charge to said piston fluid passage;

(h) said relative motion being of such a configuration and said piston intake port, said groove means, and said exhaust port being mutually positioned such that said ring means opens said exhaust port upon approaching said BDC position to exhaust an expended charge and said piston intake port aligning with said groove means thereby enabling and maintaining fluid communication between said fluid passage and said cylinder chamber subsequent to said BDC position and after said exhaust port has been closed to thereby admit a fresh fuel/air charge into said cylinder chamber;

(i) first and second banks of said cylinders, each bank including a plurality of said cylinders oriented in a parallel relation and positioned in a ring about a bank axis parallel to said cylinders, said first and second banks being rotatably supported with the bank axes thereof in an obtuse angular relation for revolution of the cylinders of each bank about the associated bank axis;

(j) said pistons being joined in pairs in said obtuse angular relation and each joined pair being received in a respective pair of said cylinders in opposite banks;

(k) each of said banks including a pair of axially spaced parallel disks oriented perpendicular to and supporting the cylinders of said bank;

(l) said engine including support means having bearing means engaged by said disks of said banks to rotatably support same;

(m) each of said pairs of disks including an inner disk, the inner disks of said banks having facing conical surfaces which are tangent at a tangent conical element line;

(n) the pistons of each of said joined piston pairs intersecting at a respective piston apex region, the piston apex regions revolving through a substantially wedge shaped annular space between said inner surfaces of said inner disks;

(o) stuffer means being positioned within internal space encircled by said annular space and filling said internal space;

(p) said support means including outer shell means sealingly engaged by said inner disks and encircling said annular space;

(q) a respective volume of said annular space between a successive set of piston apex regions diminishing upon being revolved toward a piston top-dead-center (TDC) position at said tangent line and expanding upon being revolved toward a piston bottom-dead-center (BDC) position at a location diametrically opposite said tangent line across said disks, whereby a compressible fluid within said volume is compressed upon said volume being revolved toward said TDC position and is rarefied upon being revolved toward said BDC position;

(r) fuel/air charge supply means communicating with said annular region through said outer shell means at an angular position relative to rotation of said banks at which said volumes are approaching said BDC position; and (s) apex check valve means positioned at an apex region of each of said joined pairs of pistons, said valve means being biased to open upon approaching said BDC position to communicate a compressed fuel/air charge from a respective volume into a joined pair of said pistons.

16. An engine as set forth in claim 15 wherein:

(a) said valve means are positioned about each apex region such that centrifugal force caused by revolution of said pistons urges said valve means closed when said volumes are expanding and urges said valve means open when said volumes are diminishing.

17. In an engine having a piston, a cylinder formed by a cylinder surface, and means causing cyclic relative motion between said piston and said cylinder during operation of said engine, the improvement comprising:

(a) said engine being a rotary vee engine including:

(1) said piston being cylindrical and being part of a vee shaped piston assembly including a cylindrical member intersecting said piston at an obtuse vee angle;

(2) said piston being rotatably and slidably received in said cylinder in a first rotor assembly and said cylindrical member being rotatably and slidably received in a second rotor assembly; and (3) said rotor assembly being rotatably supported to rotate about respective rotor axes intersecting at said vee angle;

(b) said relative motion including reciprocating relative motion between said piston and said cylinder and rotary relative motion between said piston and said cylinder about a cylindrical axis of said cylinder;

(c) said piston having a cylindrical piston wall which forms a fluid passage through said piston;

(d) means communicating a fuel/air charge to said fluid passage of said piston for combustion and expansion in said cylinder to displace said piston therein to operate said engine; and (e) intake port means formed through said piston wall in communication with said fluid passage and intake groove means formed into said cylinder surface which are configured and positioned in coordination with said relative motion between said piston and cylinder to cause periodic alignment of said intake port means and said groove means to enable said charge to be communicated from said passage through said intake port means and said groove means into said cylinder in a sequence timed to the relative positions of said piston and cylinder to cause operation of said engine.

18. In an engine having a piston, a cylinder formed by a cylinder wall, and means causing reciprocating relative motion and rotary relative motion between said piston and said cylinder during operation of said engine, the improvement comprising:

(a) said piston having an elongated tubular piston wall closed at ne end to partially define a fluid passage through said piston;

(b) piston intake port means including a piston intake port formed through said piston wall in axially spaced relation to said piston head and in communication with said passage;

(c) said cylinder including an elongated cylinder wall having an inner cylinder surface closed at one end by a cylinder head surface to define a cylinder chamber;

(d) cylinder intake port means including groove means formed into said cylinder wall and an exhaust port formed through said cylinder wall, said cylinder including an outer cylinder sleeve and an inner cylinder liner, said groove means being formed through said liner;

(e) means communicating a fuel/air charge to said passage for combustion and expansion in said cylinder to displace said piston therein to operate said engine; and (f) said piston intake port means and said cylinder intake port means being sized, shaped respectively, and positioned mutually in such a manner that said reciprocating and rotary relative motion between said piston and cylinder cyclically aligns said piston intake port with said groove means to cause said charge to be fluid communicated from said passage through said piston intake port and said cylinder groove means to said cylinder camber in a sequence timed to the relative positions of said piston and cylinder to cause operation of said engine.

19. An engine as set forth in claim 18 wherein:

(a) said groove means is axially elongated; and (b) said piston intake port is a circumferentially elongated piston intake slot.

20. An engine as set forth in claim 18 and including:

(a) said exhaust port being formed through said cylinder wall;

(b) said relative motion of said piston in said cylinder cyclically opens and closes said exhaust port; and (c) said piston intake port and said groove means are configured so that said communication through same continues for an interval after said piston closes said exhaust port.

21. In an engine having a piston, a cylinder formed by a cylinder wall, and means causing reciprocating relative motion and rotary relative motion between said piston and said cylinder during operation of said engine, the improvement comprising:

(a) said piston having a piston wall defining a fluid passage through said piston;

(b) means communicating a fuel/air charge to said passage for combustion and expansion in said cylinder to displace said piston therein to operate said engine;

(c) piston intake port means formed through said piston wall and in communication with said passage;

(d) cylinder intake port means including groove means formed into said cylinder wall and an exhaust port formed through said cylinder wall;

(e) said piston intake port means and said cylinder intake port means being sized, shaped, and positioned in such a manner that said reciprocating and rotary motion between said piston and cylinder causes said charge to be communicated from said passage through said piston intake port means and said cylinder intake port means to said cylinder in a sequence timed to the relative positions of said piston and cylinder to cause operation of said engine; and (f) said engine being a rotary vee engine including:

(1) a vee shaped piston member having each outer end in the form of said piston, the pistons intersecting at an obtuse vee angle;

(2) a pair of rotor assemblies supported to rotate about respective rotor axes intersecting at said vee angle, each of said rotor assemblies having a rotor cylinder in the form of said cylinder; and (3) each of said pistons being slidably and rotatably received in a respective one of the rotor cylinders.

22. In an engine having a piston, a cylinder formed by a cylinder wall, and means causing reciprocating relative motion and rotary relative motion between said piston and said cylinder during operation of said engine, the improvement comprising:

(a) said piston having a piston wall defining a fluid passage through said piston;

(b) means communicating a fuel/air charge to said passage for combustion and expansion in said cylinder to displace said piston therein to operate said engine;

(c) piston intake port means formed through said piston wall and in communication with said passage;

(d) cylinder intake port means including groove means formed into said cylinder wall and an exhaust port formed through said cylinder wall;

(e) said piston intake port means and said cylinder intake port means being sized, shaped, and positioned in such a manner that said reciprocating and rotary motion between said piston and cylinder causes said charge to be communicated from said passage through said piston intake port means and said cylinder intake port means to said cylinder in a sequence timed to the relative positions of said piston and cylinder to cause operation of said engine;

(f) a plurality of cylinders similar to said cylinder;

(g) a plurality of pistons similar to said piston;

(h) first and second banks of said cylinders, each bank including a plurality of said cylinders oriented in a parallel relation and positioned in a ring about a bank axis parallel to said cylinders;

(i) said first and second banks being rotatably supported with the bank axes thereof in an obtuse angular relation for revolution of the cylinders of each bank about the associated bank axis; and (j) said pistons being joined in pairs in said obtuse angular relation and each joined pair being received in a respective pair of said cylinders in opposite banks.

23. An engine as set forth in claim 22 wherein:

(a) each of said banks includes a pair of axially spaced parallel disks oriented perpendicular to and supporting the cylinders of said bank; and (b) said engine includes support means having bearing means engaged by said disks of said banks to rotatably support same.

24. An engine as set forth in claim 23 wherein each pair of said disks includes:

(a) an inner disk having inner ends of said cylinders in said bank extending therethrough; and (b) an outer disk having outer ends of said cylinders in said bank set therein, said outer disk forming cylinder heads of said cylinders in said bank.

25. A engine as set forth in claim 24 wherein said support means includes:

(a) a pair of support plates for each bank, each of said plates being oriented parallel to a respective one of said disks of said bank and positioned adjacent to the respective disk;

(b) an inner plate of each pair of plates having circumferentially spaced sets of rotary bearings and thrust bearings engaged by said respective disk; and (c) an outer plate of each pair of plates having circumferentially spaced sets of rotary bearings.

26. An engine as set forth in claim 23 wherein:

(a) each of said pairs of disks includes an inner disk, the inner disks of said banks having facing conical surfaces which are tangent at a tangent conical element line;

(b) the pistons of each of said joined piston pairs intersect at a respective piston apex region, the piston apex regions revolving through a substantially wedge shaped annular space between said inner surfaces of said inner disks;

(c) stuffer means is positioned within internal space encircled by said annular space and fills said internal space;

(d) said support means includes outer shell means sealingly engaged by said inner disks and encircling said annular space; and (e) a respective volume of said annular space between a successive set of piston apex regions diminishes upon being revolved toward a piston top-dead-center (TDC) position at said tangent line and expands upon being revolved toward a piston bottom-dead-center (BDC) position at a location diametrically opposite said tangent line across said disks, whereby a compressible fluid within said volume is compressed upon said volume being revolved toward said TDC position and is rarefied upon being revolved toward said BDC position.

* * * * *